US005446703A

United States Patent [19]

Schwartz

[11] Patent Number: 5,446,703

[45] Date of Patent: Aug. 29, 1995

[54] ANALOG TIMEPIECE MOVEMENT

[75] Inventor: Herbert Schwartz, Wurmberg, Germany

[73] Assignee: Timex Corporation, Middlebury, Conn.

[21] Appl. No.: 353,758

[22] Filed: Dec. 12, 1994

[51] Int. Cl.[6] ..... G04B 19/04; G04B 37/00

[52] U.S. Cl. ..... 368/80; 368/88

[58] Field of Search ..... 368/76, 80, 88, 276, 368/299, 300, 318

[56] References Cited

U.S. PATENT DOCUMENTS

| | | | |
|---|---|---|---|
| Re. 29,403 | 9/1977 | Yamazaki | 58/23 |
| 4,087,957 | 5/1978 | Miyasaka et al. | 58/23 |
| 4,144,705 | 5/1979 | Iinuma | 58/52 R |
| 4,407,586 | 10/1983 | Musy | 368/77 |
| 4,496,246 | 1/1985 | Ota | 368/88 |
| 4,748,603 | 5/1988 | Ray et al. | 368/80 |
| 5,155,711 | 10/1992 | Schwartz | 368/80 |
| 5,210,722 | 5/1993 | Schwartz | 368/88 |
| 5,265,071 | 11/1993 | Thorgersen et al. | 368/67 |

*Primary Examiner*—Vit W. Miska

*Attorney, Agent, or Firm*—William C. Crutcher

[57] ABSTRACT

An improved movement for an analog wristwatch of the type having a plastic frame with a peripheral wall surrounding a central wall. The central wall carries gear trains on the dial side and movement side of the wall and a stepping motor driving the gear trains to drive the watch hands. An annular printed circuit board carries discrete electronic components disposed on one side and electrically connected thereto. The peripheral wall of the frame includes coplanar mounting surfaces arranged to support the PCB and has discrete recesses surrounding the central wall which receive the discrete electronic components when the annular PCB is so supported. An annular conductive spring plate disposed on the annular PCB performs various switching functions. The spring plate and the printed circuit board are held down against the coplanar mounting surfaces, and a thin, large diameter lithium energy cell fits inside the annular members.

10 Claims, 8 Drawing Sheets

FIG. 10
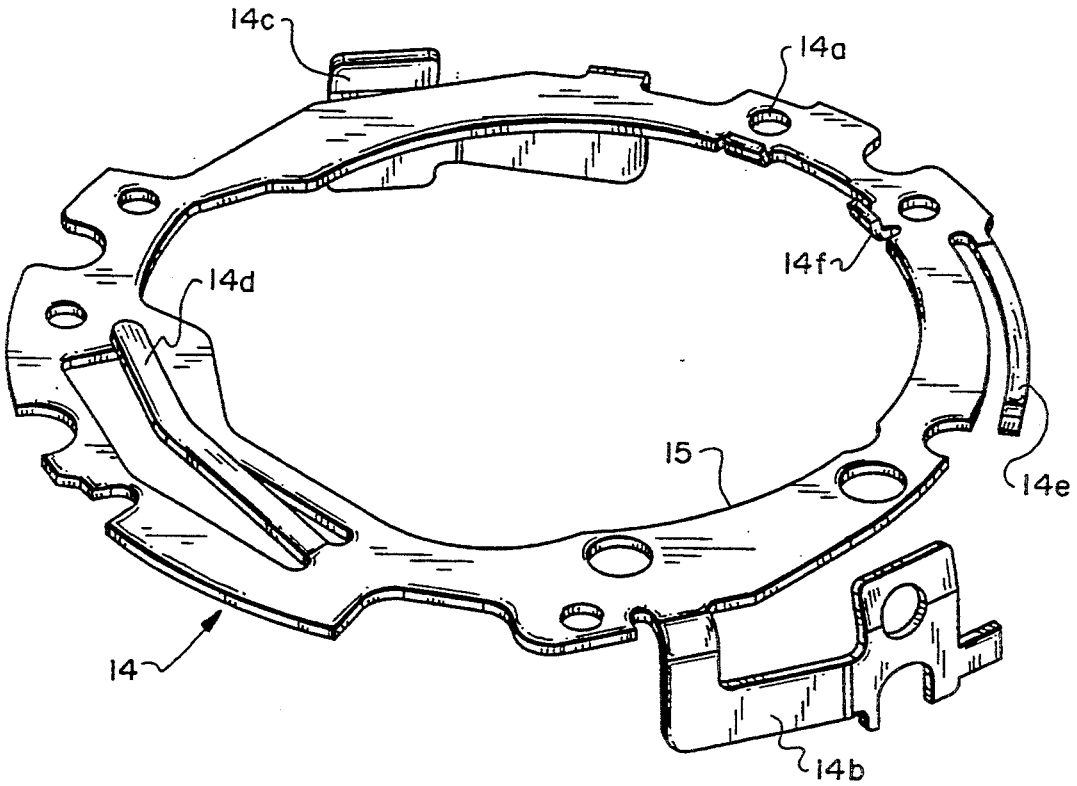
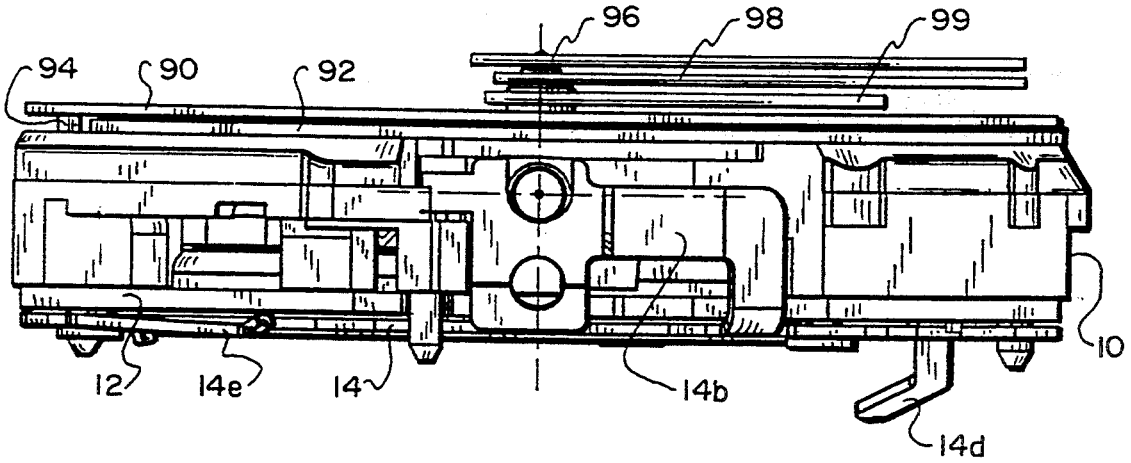
FIG. 11

ANALOG TIMEPIECE MOVEMENT

BACKGROUND OF THE INVENTION

This invention relates generally to improvements in analog timepiece movements, and more particularly to movements for quartz analog timepieces intended to be powered by a large diameter thin energy cell and intended to operate with an electroluminescent lighted dial.

An analog timepiece movement of the general type is shown in U.S. Pat. No. 5,210,722 dated May 11, 1993 in the name of the present inventor and assigned to the present assignee. The movement illustrated in the aforementioned patent is of the type having a molded frame of insulating material with a peripheral side wall and a central wall rotatably supporting a dial side gear train on one side and a movement side gear train on the other side with the assistance of a bridge. The bridge and the central wall house the stepping motor and the movement side gear train which is connected, by means of a third wheel assembly to drive the dial side gear train which, in turn, drives the hour and minute hands of the timepiece. U.S. Pat. No. 5,210,722, which is incorporated herein by reference, is arranged on the movement side to contain a large diameter, thin energy cell. The printed circuit board with some discrete electronic components attached thereto is located in the frame beneath the energy cell, the latter being displaced to one side in an elliptical frame envelope to accommodate the quartz crystal adjacent the energy cell.

Analog wristwatches have recently begun to use electroluminescent lighting to illuminate the watch dials. An example of an electroluminescent watch dial is shown in U.S. Pat. No. 4,775,964 issued Oct. 4, 1988 in the names of Alessio et al, and assigned to the present assignee. Such an electroluminescent dial requires an efficient circuit to drive it, such a circuit being exemplified in U.S. Pat. No. 4,527,096 issued Jul. 2, 1985 to Kindlmann, incorporated in an integrated circuit, and also requires discrete electronic components such as one or more external inductors, which are usually carried on a separate printed circuit board (PCB) with the integrated circuit for the electroluminescent (EL) watch dial. Therefore the need to adapt the analog watch movement to function with an EL dial has necessitated a separate PCB and need to locate it along with its discrete components, as well as to make all of the additional required connections.

Each additional movement part, assembly and subassembly which must be handled adds to the cost of the analog timepiece. Therefore it is desirable to utilize a minimum number of components and to require each component to perform more than one function if possible. The electronic PCB assemblies should be completed to the greatest extent possible before assembly into the movement, at which time the number of connections made should be as few as possible. Also, the movement should be adaptable and flexible for use in many styles and models of watches.

Accordingly, one object of the present invention is to provide an improved analog timepiece movement for use with a large diameter energy cell and an electroluminescent dial.

Another object of the invention is to provide an improved quartz analog timepiece movement, provide an improved arrangement for the frame and printed circuit board with discrete electronic components.

Still another object of the invention is to provide an improved quartz analog timepiece movement utilizing a minimum number of parts and requiring a minimum number of connections during assembly.

DRAWINGS

The invention will best be understood by reference to the following description, taken in connection with the accompanying drawings, in which:

FIG. 1 is an isometric view of the assembled movement, without the watch case, viewed from the movement side, FIG. 2 is an isometric view of the assembled movement, viewed from the opposite or dial side, without the dial or watch hands, FIG. 3 is a plan view of the movement side of the assembled movement, FIGS. 4, 5 and 6 are developed elevational views taken along the respective section lines from IV—IV, V—V, and VI—VI, of FIG. 3, FIG. 7 is an isometric view of the frame of the movement, taken from the movement side and viewed from the same point as the corresponding view in FIG. 1, FIG. 8 and 9 are isometric views of dial side and movement side respectively of the PCB prior to assembly in the movement, FIG. 10 is an isometric view of the movement side of the conductive spring plate prior to assembly in the movement, and FIG. 11 is a side elevation view of the movement with dial and watch hands, known as a "fitup".

SUMMARY OF THE INVENTION

Briefly stated, the invention comprises an improved movement for an analog wristwatch of the type having a plastic frame with a peripheral wall surrounding a central wall, which supports a stepping motor and a gear train connected to the stepping motor and adapted to drive analog watch hands.

The improvement comprises an annular printed circuit board, a plurality of discrete electronic components disposed on one side of the annular printed circuit board and electrically connected thereto, the peripheral wall of the frame defining a plurality of discrete recesses surrounding the central wall and adapted to receive the discrete electronic components when the annular printed circuit board is so supported, an annular conductive spring plate disposed on the annular printed circuit board, means for holding the spring plate and the printed circuit board against the peripheral wall, and wherein the annular conductive spring plate and annular printed circuit board together define an opening dimensioned to receive a circular energy cell.

In its preferred embodiment, the peripheral wall defines coplanar mounting surfaces which support the printed circuit board and the spring plate. The spring plate includes spring contacts for connecting with the watch caseback, the PCB and the energy cell and a pair of peripherally spaced switching arms for making momentary contact with peripherally spaced terminals on the PCB when actuated by manual actuators.

In its preferred embodiment, the printed circuit board includes a first group of discrete electronic components comprising an EL driver integrated circuit and an inductor connected to supply EL driving potentials.

The PCB also includes a second group of discrete electronic components comprising a second integrated circuit and a quartz crystal connected to supply timekeeping drive signals to the stepping motor.

The preferred means holding the annular conductive spring plate and PCB against the frame comprise integral plastic posts or pins projecting from the coplanar mounting surfaces on the frame, which are secured by ultrasonic welding.

DESCRIPTION OF THE PREFERRED EMBODIMENT

Figure 1:
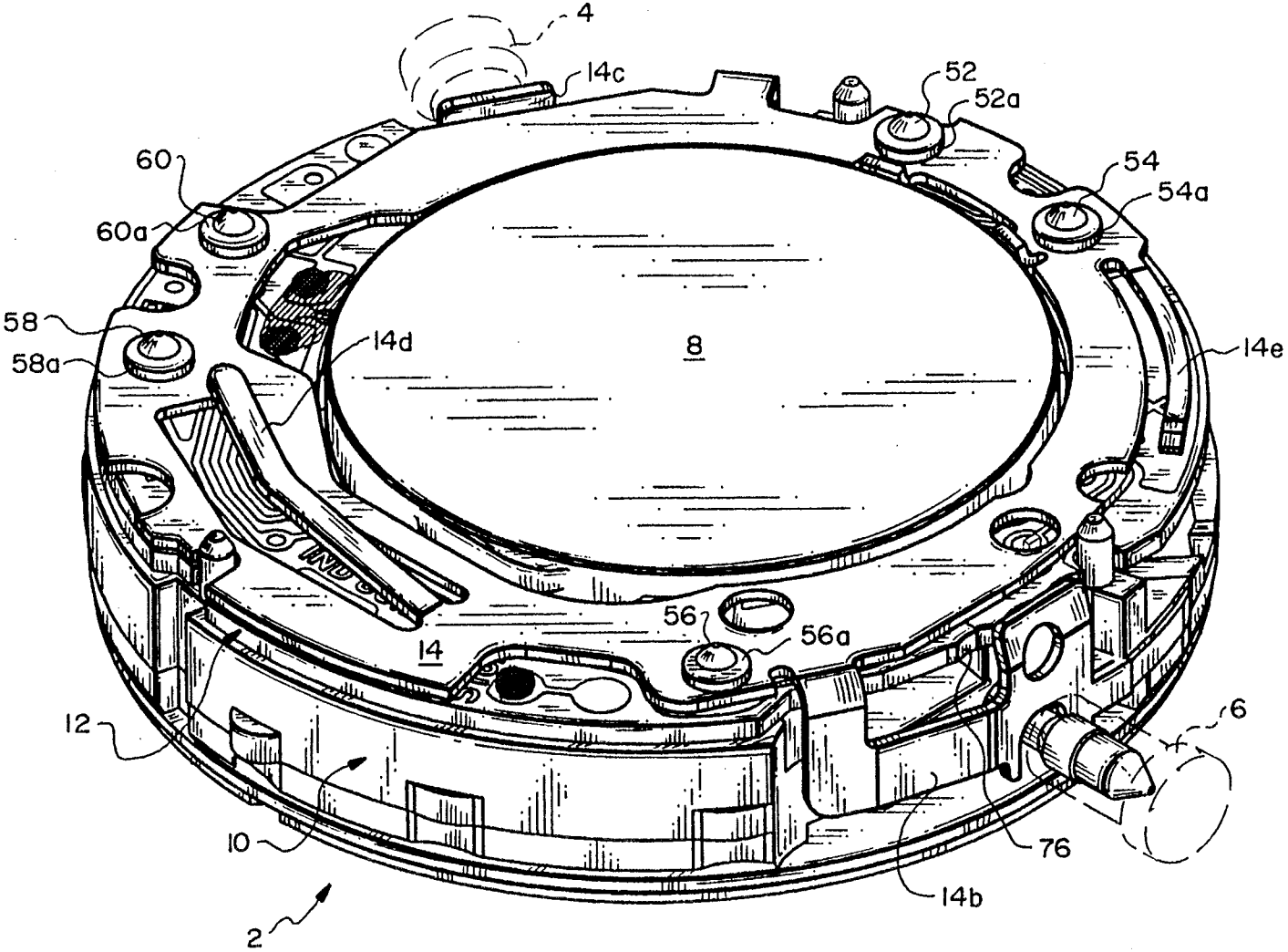
Figure 2:
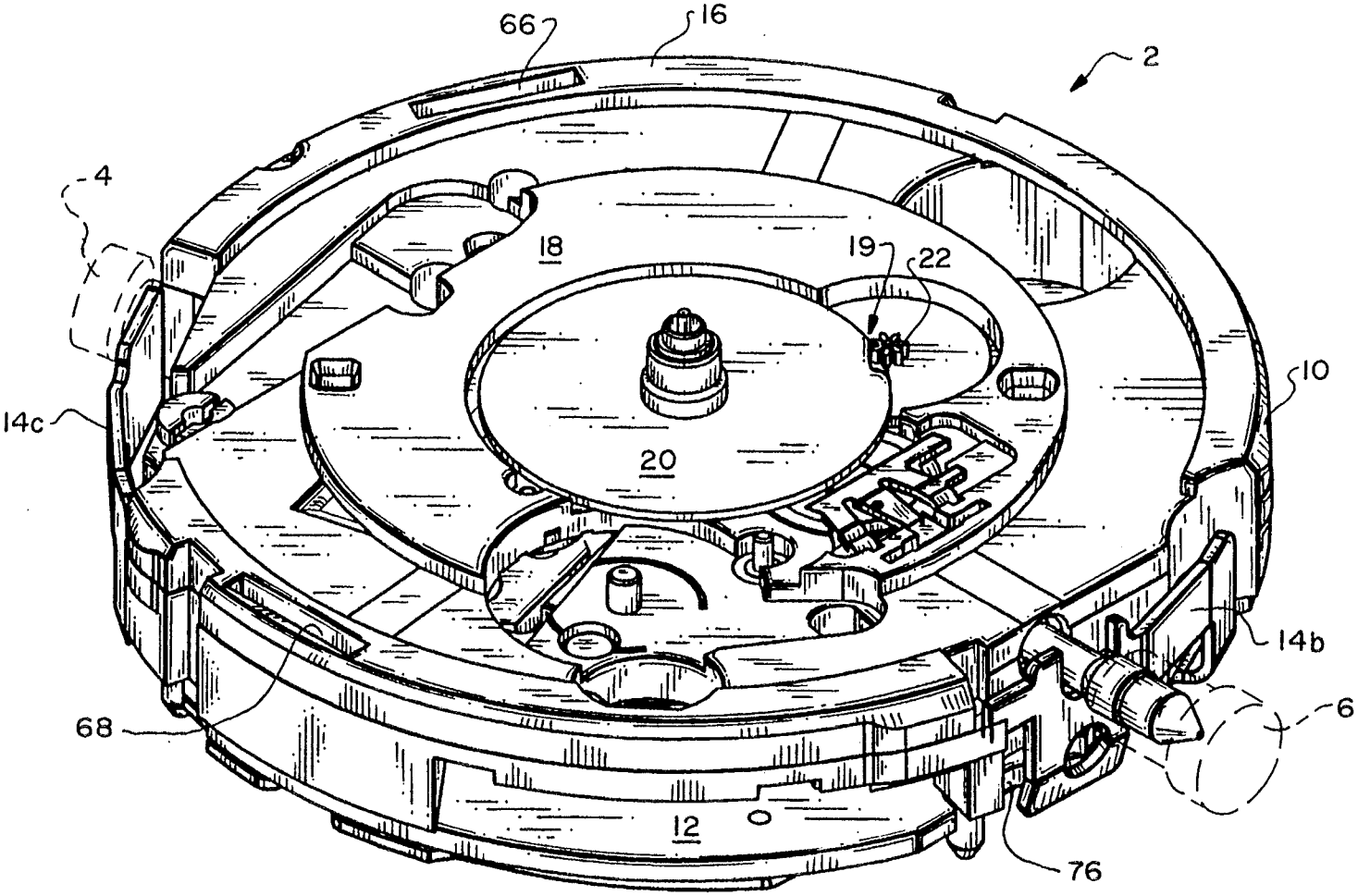

Referring now to FIG. 1 and FIG. 2 of the drawing, isometric views are shown of the movement side and dial side respectively of an improved timepiece movement assembly 2. As is conventional in the timekeeping industry, movement 2 does not include other timekeeping components such as a dial and timekeeping hands, and is also shown without a watch case, which would contain movement 2. However in order to illustrate the operation of the invention, some components are shown in phantom line which would be required to operate the movement after final assembly, such as an EL pushbutton actuator 4, and a rotatable time setting stem 6 (which can optionally also include a pushbutton actuator). A circular energy cell 8, commonly a large diameter, thin lithium type cell, powers the movement and the electroluminescent lighting circuit for the dial.

The major components of the movement 2, which may be seen in FIGS. 1 and 2 are a frame 10 of plastic insulating material, which serves as the main supporting or structural member of the movement, an annular printed circuit board or PCB 12, and an annular conductive spring plate 14, which are seen from the movement side in FIG. 1.

Figure 3:
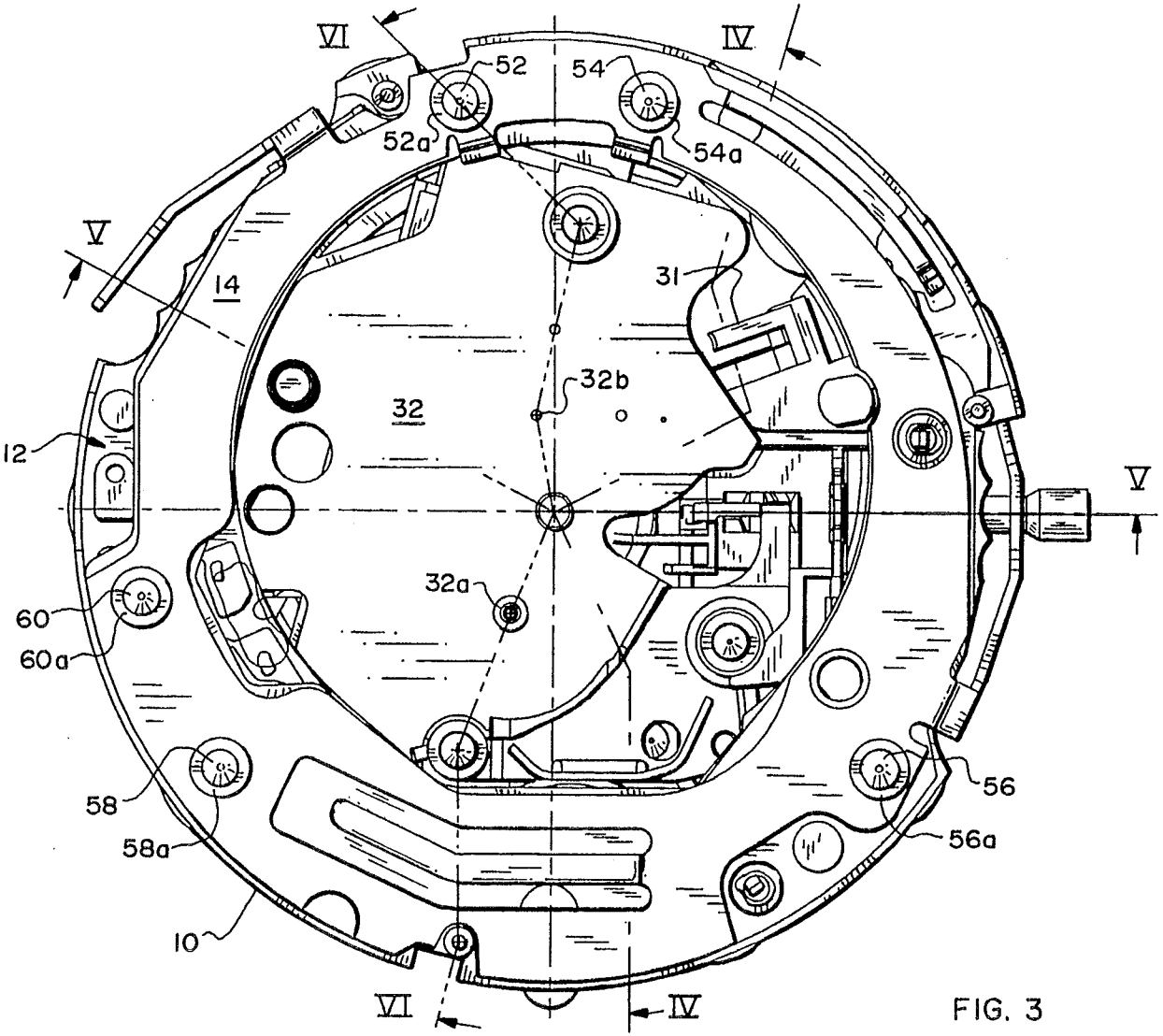

In FIG. 2, frame 10 is shown comprised of a peripheral wall 16 surrounding a central wall 18 of irregular shape which serves to divide the dial (front) side from the movement (back) side. Central wall 18 supports various functional members of the movement including the gear train. In FIG. 2 a portion of a dial side gear train 19 can be seen having an hour wheel 20 driven by a minute wheel assembly 22. In FIG. 1 the components supported by central wall 18 are obscured by energy cell 8. FIG. 3 is a plan view of the movement side similar to the isometric view of FIG. 1, but with the energy cell 8 removed to expose an energy cell contact spring 31, and a bridge 32 of insulating material which supports the energy cell. FIG. 3 may be used also to identify the cross-sectional views of FIGS. 4, 5, and 6, which are developed elevational views taken along the section lines designated as IV—IV, V—V and VI—VI respectively in FIG. 3, except that the energy cell 8 is added to the section views of FIGS. 4, 5, and 6.

Figure 6:
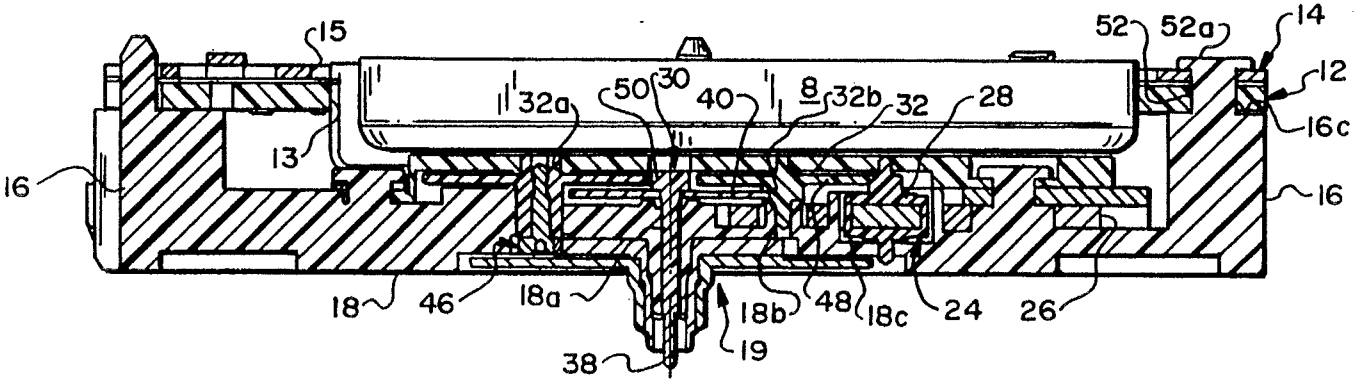

As best seen in FIG. 6, a stepping motor shown generally at 24 includes a stator assembly 26 and a rotor 28. The rotor drives a movement side gear train shown generally at 30. Details of the stepping motor 24 and movement side gear train 30 are found by way of example in my aforementioned U.S. Pat. No. 5,210,722. Referring again to FIG. 3, the bridge 32 serves to rotatably support the movement side gear train 30 by means of bores such as **32*a*, 32*b*, each of which have a corresponding aligned bore in central wall 18**, again as illustrated in my aforementioned U.S. Pat. No. 5,210,722. However in that patent, the bridge also covered the printed circuit board and some of the discrete electronic components, which had to be fitted alongside the stepping motor and gear train on the movement side causing a congested condition. Since an electroluminescent lamp also requires a PCB and additional discrete electronic components, the arrangement illustrated in my U.S. Pat. No. 5,210,722 was not as satisfactory for an EL timepiece and led to the improvement of the present invention.

Figure 4:
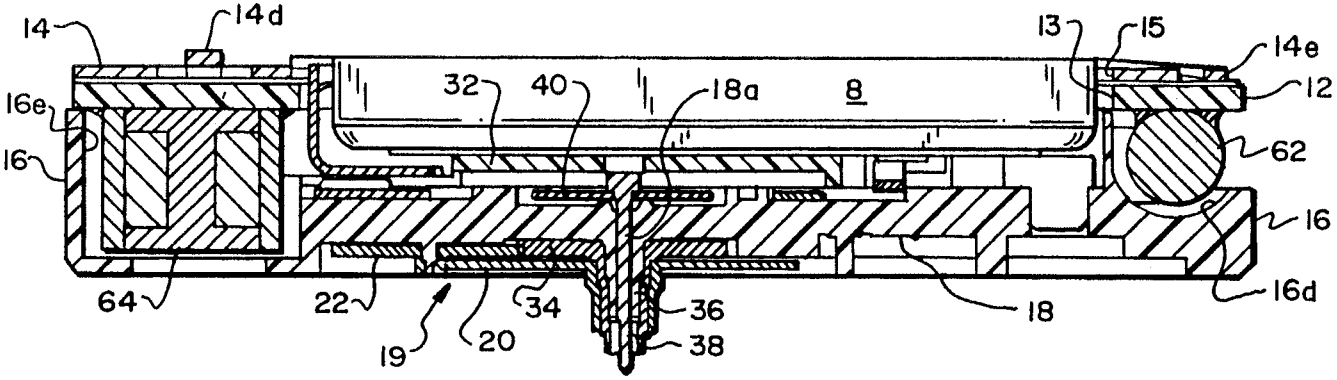

FIG. 4 shows that the central wall 18 extends across the movement to the peripheral wall 16 on either side. The dial side gear train includes the hour wheel 20 driven by the minute wheel assembly 22, which, in turn is driven by a center wheel 34. Wheels 20, 34 are rotatably mounted on a center post 36 with a bore **18*a*, and which is molded as part of the central wall 18. A seconds spindle 38 projects through bore 18*a* of center post 36, and is rotated by a seconds wheel 40 on the movement side. Portions of the bridge are seen at 32**.

Figure 5:
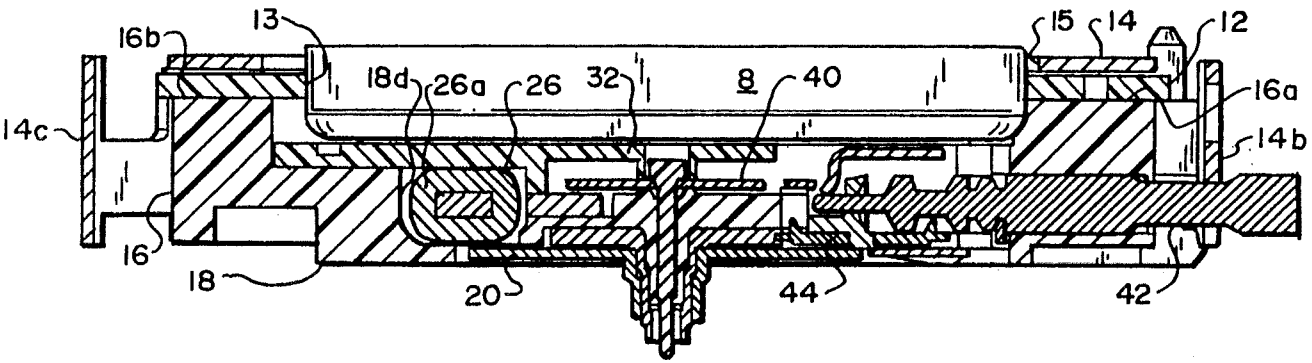

Referring to FIG. 5 of the drawing, a part of the stepping motor stator 26 is shown as coil **26*a* disposed in a recess 18*d*. A watch crown and stem set assembly 42 is axially slidable to engage a setting wheel 44 and also rotatable to cause setting wheel 44 to rotate the center wheel and hour wheel to set the watch hour and minute hands. To allow this to be done without stripping the gears (because of the holding torque of the stepping motor gear train), a third wheel assembly 46 (see FIG. 6**) with a special frictional slip clutch is provided. The latter is more fully and completely described in U.S. Pat. No. 5,155,172 issued Oct. 13, 1992 in the names of Fredrik Mose, Michel Plancon and Herbert Schwartz, which patent is incorporated herein by reference.

FIG. 6 also shows elements of the movement side gear train which are rotatably mounted in the bridge 32. Starting on the right, the pinion of the stepping motor rotor 28 drives an intermediate wheel assembly 48, which drives the seconds wheel 40. A pinion 50 on the seconds wheel spindle 38 drives the third wheel assembly 46. Bridge 32 and central wall 18 include cooperating pairs of bores which rotatably support elements of the movement side gear train.

Referring now to the improvement of the present invention, the peripheral wall 16 serves to support the annular printed circuit board 12 and the conductive annular spring plate 14 on a group of coplanar mounting surfaces located on the movement side around the peripheral wall 16, two of these seen most clearly as **16*a* and 16*b* in FIG. 5. On selected mounting surfaces, such as surface 16*c* shown in FIG. 6, integral posts 52 project from the mounting surfaces, which fit through corresponding holes in the annular printed circuit board 12 and the annular spring plate 14. During assembly, the annular members are preferably secured against the coplanar mounting surfaces on the peripheral wall by ultrasonic welding. This causes the tops of the posts 52 to upset and form flanges as illustrated at 52*a* in FIG. 6**, providing a means to hold annular members against the mounting surfaces. Of course alternate methods such as screws may be used to attach the annular members to the peripheral wall of the frame without departing from the scope of the present invention.

Referring to FIG. 1 of the drawing, the post 52 is shown after it has been upset by ultrasonic welding to provide the flattened flanges **52*a***.

Similar integral posts are shown projecting from the holes in conductive plate 14 around the assembly of FIG. 1 as reference numbers 54, 56, 58 and 60, with respective flanges after they have been flattened to secure the spring plate 14 seen at **54*a*, 56*a*, 58*a* and 60*a***.

FIGS. 4, 5, and 6 show the energy cell 8 is housed within an opening which is defined in part by a central opening 13 in PCB 12, and by a central opening 15 in spring plate 14. The energy cell rests on bridge 32 so that it is contained within movement 2.

Another important feature of the invention is illustrated in the cross sectional view of FIG. 4. Printed circuit board 12 is arranged to carry a number of discrete electronic components. Two of these are seen in FIG. 4 as a quartz crystal 62, which is connected in circuit with the integrated circuit providing the timekeeping function and an inductor 64, which is connected in circuit with the integrated circuit providing the electroluminescent drive circuit. These discrete electronic components are accommodated by means of discrete recesses or cutouts 16*d* and 16*e* respectively which are distributed around the peripheral wall 16.

Figure 7:
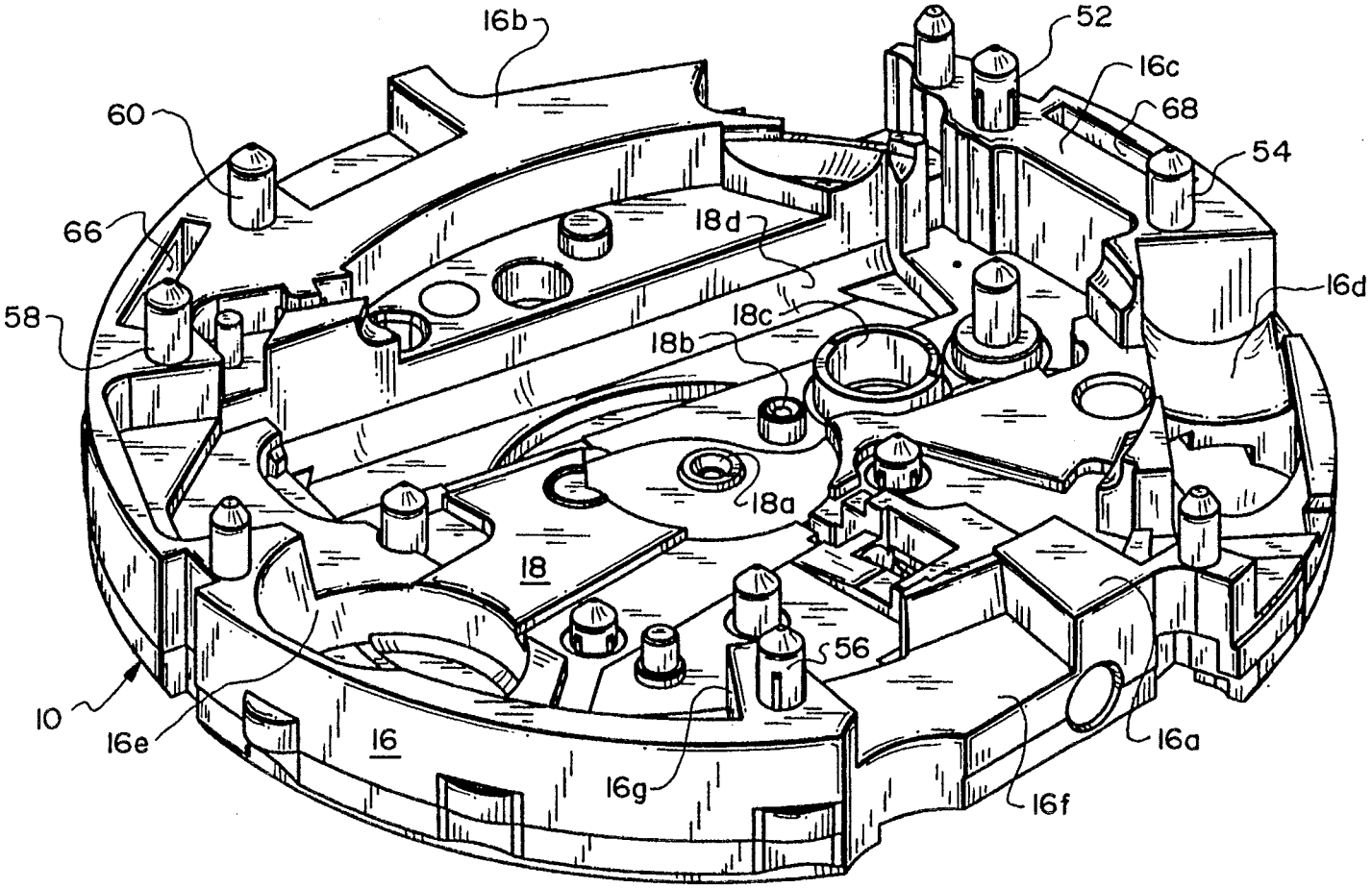

The major components of the improved movement will now be described. Referring now to FIG. 7 of the drawing, a frame 10 (without any other elements) is preferably molded of insulating plastic material with a peripheral wall 16 surrounding a central wall 18. Central wall 18 is of extremely irregular and specialized shape, which is enabled by precision injection molding techniques. It includes a central bore 18*a* for the seconds wheel assembly, a bore 18*b* for the intermediate wheel assembly, a recess 18*c* for the stepping motor rotor, and a recess 18*d* for the stepping motor stator.

The annular members are supported on peripheral wall 16. The coplanar mounting surfaces 16*a*, 16*b*, 16*c* merge with other coplanar mounting surfaces which may be seen disposed around the peripheral wall 16.

The integral mounting pins 52, 54, 56, 58 and 60 may be seen projecting from the coplanar mounting surfaces. Discrete recesses or cutouts 16*e*, 16*d* are illustrative of other such recesses or cutouts around the frame. The frame also includes a slot at 66 and a slot at 68 to hold electrical connector members (not shown) for making contact between EL terminals on the PCB and the electroluminescent dial.

Figure 8:
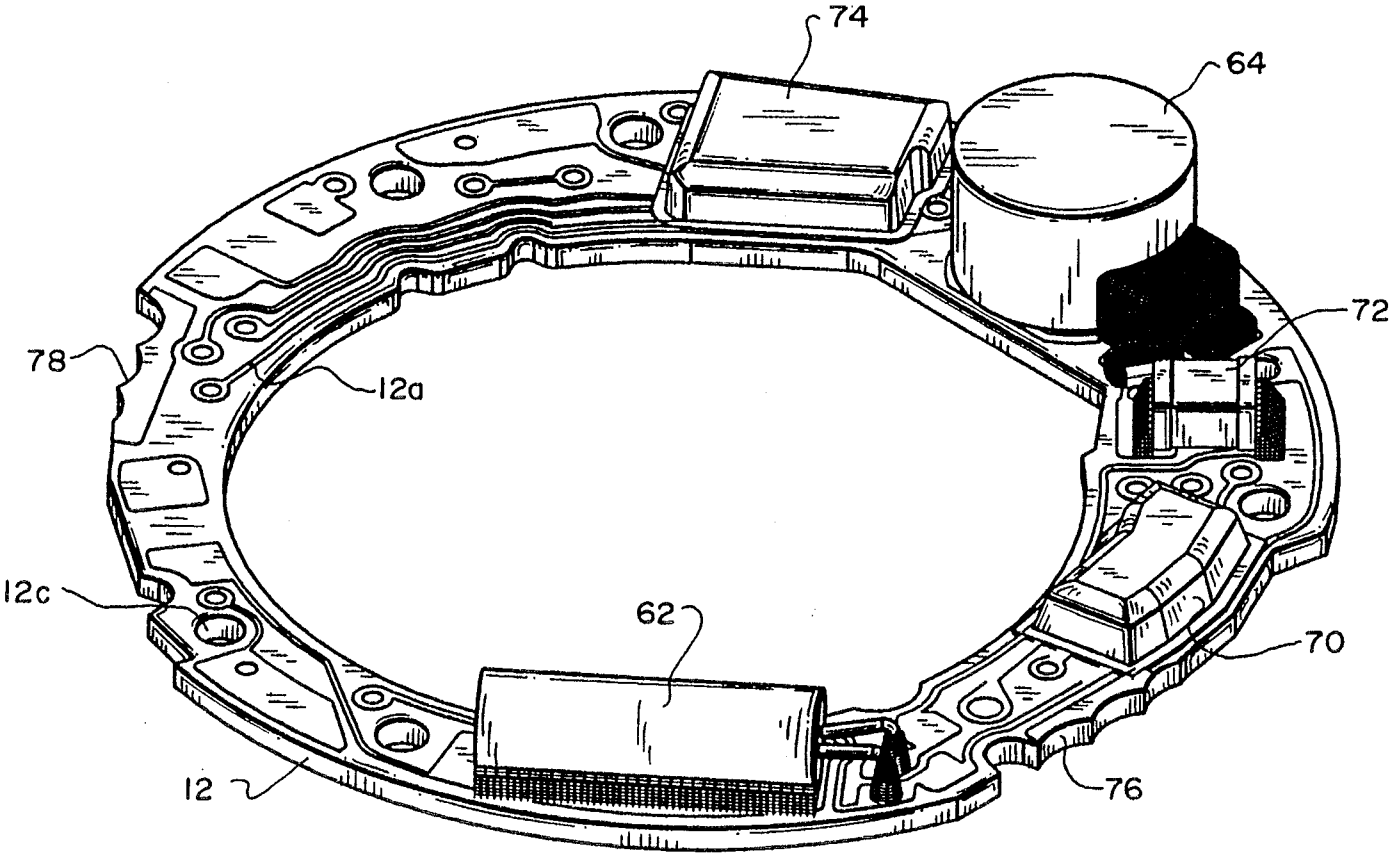
Figure 9:
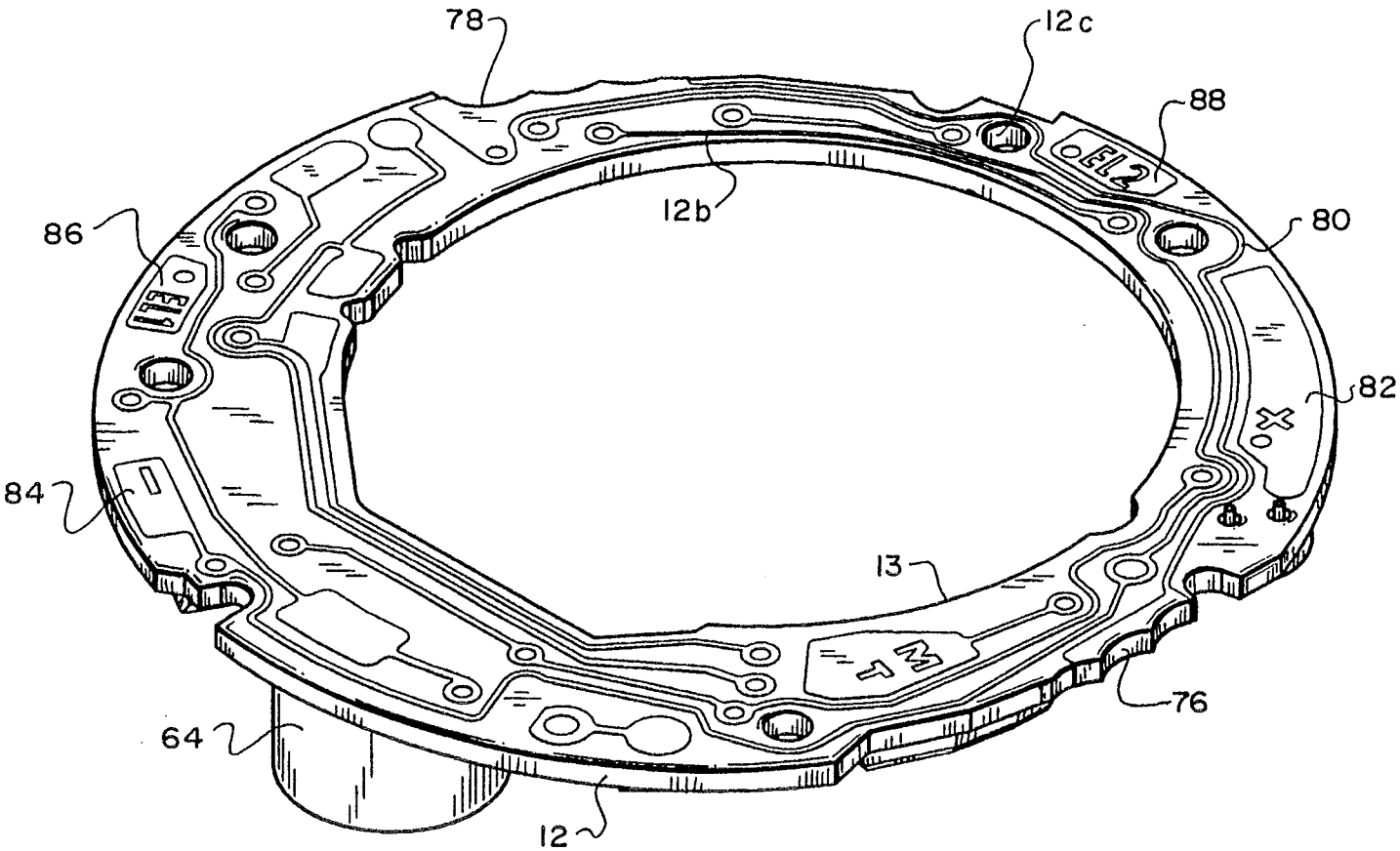

Referring now to FIGS. 8 and 9 of the drawing, the improved annular printed circuit board of the present invention is shown from the dial side and movement side respectively to include the conventional traces 12*a* on the dial side and 12*b* on the movement side which serve to connect together the discrete components. In FIG. 8, the discrete components include quartz crystal 62 previously referred to, connected in circuit with a timekeeping integrated circuit 70 wire bonded to the appropriate traces and protected in a housing in the conventional manner. The EL drive circuit includes the previously mentioned inductor 64, and a ceramic capacitor 72, connected in circuit with an EL driver integrated circuit 74 which is also wire bonded to the appropriate traces and contained within a protective housing. The integrated circuits 70 and 74 are contained in protective housings of significant size and are also defined for purpose of this application as discrete components. The discrete components 62, 64, 70, 72 and 74 being of substantial size and of various shapes, are accommodated by appropriate recesses or cutouts in the peripheral wall 16.

Referring to FIG. 7, integrated circuit 70 is contained in recess 16*f*, ceramic capacitor 72 is contained in recess 16*g*, and integrated circuit 74 is contained in recess 16*h*.

FIG. 9 illustrates the movement side of the annular PCB shown in FIG. 8. At two peripherally spaced locations on the periphery of annular PCB 12, switching terminals 76, 78 connected by a trace 80 are shown, which provide alternate optional terminal locations for cooperation with resilient switching arms on the conductive spring plate. Also terminals 82, 84 provide for connection to the positive and negative terminals of the energy cell. Terminals 86, 88 are output terminals from the electroluminescent drive circuit which are aligned with slots 66, 68 respectively (FIG. 7). Holes such as 12*c* which receives pin 52, are distributed around the annular printed circuit board. The central opening 13 is dimensioned to receive a circular energy cell.

Referring to FIG. 10 of the drawing, the conductive annular spring plate 14 is shown in more detail. It also includes holes such as 14*a* distributed around the annulus and arranged to coincide with holes such as 12*c* on the PCB. A resilient switching arm 14*b* cooperates with the rotating stem and pushbutton actuator 6 (see FIG. 1) to provide a switch closure for actuating the electroluminescent drive circuit. Alternatively, (or optionally) a second resilient switching arm 14*c* is similarly arranged to be actuated by the pushbutton actuator 4 of FIG. 1 to provide a second switch closure. A third resilient grounding arm 14*d* is arranged to extend upward toward the caseback to make grounding contact with the caseback of the watch. A fourth resilient power supplying arm 14*e* extends downwardly from the annular PCB to make electrical contact with the positive battery terminal 82 (FIG. 9), thereby grounding the positive energy cell terminal, which is conventional in timekeeping. The central opening 15 is dimensioned to receive a circular energy cell, and is slightly larger than opening 13 in the PCB. Spring tabs 14*f* on the spring plate extend radially inward to contact the energy cell and assist in holding the energy cell 8 and assuring positive contact.

Referring now to FIG. 11 of the drawing, the assembled movement is shown together with dial and hands, which is sometimes referred to as a "fit up". Movement 2 is assembled as previously described. It will be understood that thin insulating sheets are required between conductive spring plate 14 and PCB 12 in some places in order to prevent shorting between electrical traces.

A timepiece dial 90 constructed along the lines of the aforementioned U.S. Pat. No. 4,775,964 is supported on an underlying plate 92. Dial 90 is supported by plate 92 and arranged to be contacted on the underside of dial 90 by means of electrically conductive connectors such as 94 extending through the frame. See also FIG. 2. For an exemplary patent showing an electroluminescent dial support and connector assembly, see U.S. Pat. No. 5,265,071 in the names of Harold Thorgersen et al issued Nov. 23, 1993 and assigned to the present assignee. The watch hands are shown as second hand 96, minute hand 98 and hour hand 99 above the dial 90.

It remains to note that the annular spring plate member, the annular PCB and portions of the frame and bridge together are arranged and dimensioned so as to receive a standard circular lithium energy cell of the type which has a large diameter and is thin. An appropriate size circular energy cell for the movement described is cell CR 1216, which has a diameter of 1.2 centimeters and a thickness of 1.6 millimeters. In this manner, the energy cell is smoothly and effectively accommodated within the assembled movement so as to provide an extremely thin and compact watch movement. The energy cell is effectively held by means of the spring tabs 14*f* which provide positive contact with the battery positive terminal and which, through the conductive ring and spring member 14e connect with the PCB terminal 82. Similarly the negative battery terminal is connected to PCB terminal 84 by the energy cell contact spring 31.

While there has been described what is considered the preferred embodiment of the invention, other modifications will occur to those skilled in the art, and it is desired to secure in the appended claims all such modifications as fall within the true spirit and scope of the invention.

I claim:

1. An improved movement for an analog wristwatch of the type having a plastic frame with a peripheral wall surrounding a central wall, said central wall supporting a stepping motor and a gear train connected to said stepping motor and adapted to drive analog watch hands, wherein the improvement comprises:

an annular printed circuit board, a plurality of discrete electronic components disposed on one side of said annular printed circuit board and electrically connected thereto, said peripheral wall of said frame arranged to support said printed circuit board and further defining a plurality of discrete recesses surrounding said central wall and adapted to receive said discrete electronic components when the annular printed circuit board is so supported, an annular conductive spring plate disposed on said annular printed circuit board, means for holding the spring plate, and the printed circuit board against said peripheral wall, and said annular conductive spring plate, and said annular printed circuit board together defining an opening dimensioned to receive a circular energy cell.

2. The improvement according to claim 1, wherein said peripheral wall defines a plurality of coplanar mounting surfaces supporting said printed circuit board, and wherein said holding means secures said spring plate to said coplanar mounting surfaces.

3. The improvement according to claim 1, wherein said annular printed circuit board and said annular conductive spring plate together define a plurality of aligned peripheral holes, and wherein said holding means comprises a plurality of plastic posts on said peripheral wall and integral with said frame and extending through said aligned peripheral holes, and wherein said plastic posts are upset against the conductive spring plate.

4. The improvement according to claim 1, wherein said discrete electronic components comprise a first integrated circuit adapted for timekeeping and a quartz crystal connected thereto.

5. The improvement according to claim 1, wherein said discrete electronic components comprise a second integrated circuit adapted for driving an electroluminescent lamp, and an inductor connected thereto.

6. The improvement according to claim 1, wherein said annular printed circuit board includes at least one terminal on its peripheral edge connected in circuit with selected discrete components, and wherein said annular conductive spring plate includes at least one resilient switching arm spaced from said terminal and adapted to be pushed against said terminal by a manual actuator.

7. The improvement according to claim 6, wherein there are at least two of said terminals comprising first and second peripherally spaced terminals on said printed circuit board and wherein there are at least two of said switching arms respectively comprising first and second peripherally spaced switching arms on the conductive spring plate, whereby said selected discrete components may be actuated from alternate peripheral locations on the movement.

8. The improvement according to claim 1, wherein said spring plate includes a resilient grounding arm extending away from the movement and adapted to contact a watch case containing the movement, and also includes a resilient power supplying arm extending so as to contact said printed circuit board.

9. The combination according to claim 8, wherein said spring plate further includes at least one spring tab extending radially inward to contact the energy cell and arranged to aid in retaining an energy cell in said movement.

10. An improved movement for an analog wristwatch of the type having a plastic frame with a peripheral wall surrounding a central wall, said central wall dividing a dial side from a movement side, a dial side gear train rotatably mounted on the dial side of said central wall and adapted to drive analog watch hands, a movement side gear train rotatably mounted on the movement side of said central wall and adapted to drive the dial side gear train, and a stepping motor connected to drive the movement side gear train wherein the improvement comprises:

an annular printed circuit board, a plurality of discrete electronic components disposed on one side of said annular printed circuit board and electrically connected thereto, said peripheral wall of said frame defining a plurality of coplanar mounting surfaces arranged to support said printed circuit board and further defining a plurality of discrete recesses surrounding said central wall and adapted to receive said discrete electronic components when the annular printed circuit board is so supported, an annular conductive spring plate disposed on said annular printed circuit board, means for holding the spring plate, and the printed circuit board against said coplanar mounting surfaces, and said frame, said annular conductive spring plate, and said annular printed circuit board together defining a housing dimensioned to contain a standard size, thin, circular lithium energy cell.

* * * * *